United States Patent [19]

Moore

[11] 4,359,949

[45] Nov. 23, 1982

[54] STRUCTURAL WATER SEAL TROUGH

[75] Inventor: Richard F. Moore, Tolland, Conn.

[73] Assignee: Combustion Engineering, Inc., Windsor, Conn.

[21] Appl. No.: 311,573

[22] Filed: Oct. 15, 1981

[51] Int. Cl.[3] ..... F23J 1/00

[52] U.S. Cl. ..... 110/171; 432/242; 110/165 R

[58] Field of Search ..... 110/165 R, 165 A, 170, 110/171; 432/115, 242; 34/242; 126/242

[56] References Cited

U.S. PATENT DOCUMENTS

| | | | |
|---|---|---|---|
| 2,339,216 | 1/1944 | Allardice | 110/171 |
| 3,580,226 | 5/1971 | Blackburn, Jr. | 110/171 |
| 3,834,328 | 9/1974 | Blazewicz et al. | 110/171 |
| 3,857,344 | 12/1974 | Coulter | 110/171 |
| 3,940,239 | 2/1976 | Rossi et al. | 432/115 |
| 4,111,439 | 9/1978 | Schmidt | 432/115 |
| 4,112,856 | 9/1978 | Fuhrman et al. | 110/171 |
| 4,193,756 | 3/1980 | Leon | 432/115 |
| 4,301,746 | 11/1981 | Pech et al. | 110/171 |
| 4,321,876 | 3/1982 | Mikus et al. | 110/171 |

*Primary Examiner*—Henry C. Yuen

*Attorney, Agent, or Firm*—Robert L. Olson

[57] ABSTRACT

Apparatus for handling ash and slag produced in the combustion of coal or other ash-bearing fuel in a top-supported furnace (10) of a steam generator, including a submerged scraper conveyor unit (14) beneath the furnace (10), and a water seal (24, 26) including a bottom-supported trough (26) positioned beneath the furnace (10), and plates (24) secured to the furnace bottom extending down into the trough (26). The submerged scraper conveyor unit (14) is bottom-supported independently of the trough (26), and there is an adjustable (34) seal member (29) between the two to prevent gas leakage therebetween.

1 Claim, 2 Drawing Figures

STRUCTURAL WATER SEAL TROUGH

BACKGROUND OF THE INVENTION

In coal-fired steam generators, the manner in which the ash is handled and disposed of is an item of considerable importance. One means used today for continuously removing ash and slag which falls through an opening in the furnace bottom is a scraper conveyor which is submerged in a tank of water. When the unit is shutdown for periodic maintenance, it is desirable to be able to move the entire scraper conveyor unit, including the tank in which it is housed, from beneath the furnace so that it can be easily worked on, and so that it can be replaced with another unit if major repair is required.

A water seal is generally provided for preventing the atmosphere from being exposed to the furnace interior. This consists of a plate extending down and surrounding the furnace bottom opening, which plate extends into the submerged scraper conveyor tank, which tank is filled with water, thus forming a water seal. This type of seal is provided because it allows the furnace to grow relative to the submerged scraper conveyor unit caused by thermal expansion. Large furnaces are generally top-supported, so that they are free to expand in a downward direction when the unit is first started up. This growth can be on the order of ten-twelve inches from the cold to the hot condition. The above provides the problem of how to be able to quickly remove the submerged scraper conveyor unit from beneath the furnace when the unit is shutdown for maintenance. In the past, it has been necessary to allow the unit to cool down to a point where workmen can unbolt the seal plate from the furnace bottom. This cooling and unbolting time is considerable and can cause the entire steam generator to be down for lengthy maintenance periods.

SUMMARY OF THE INVENTION

In accordance with the invention, a bottom-supported submerged scraper conveyor unit is provided beneath a top-supported coal-fired furnace, and a water seal is provided therebetween to prevent the furnace gases from escaping to the atmosphere. The water seal is formed by a bottom-supported trough, and plates extending down from the furnace bottom into the water in the trough. The submerged scraper conveyor unit is bottom-supported independently of the trough, and there is an adjustable seal member therebetween to prevent gas leakage.

DESCRIPTION OF THE PREFERRED EMBODIMENT

Figure 1:
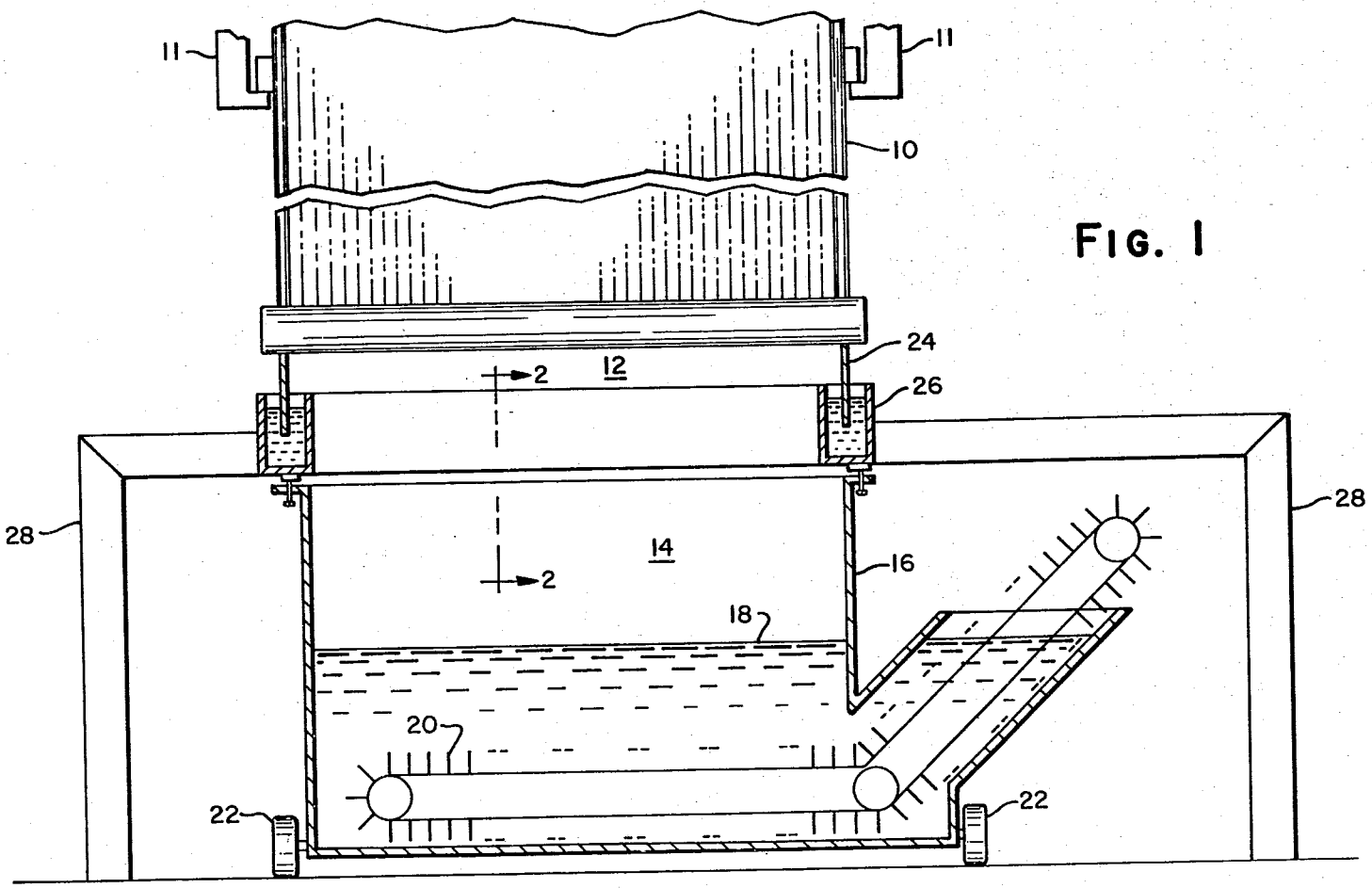
FIG. 1 is a sectional side view of a submerged scraper conveyor unit beneath a furnace constructed in accordance with the present invention.

Looking now to FIG. 1, numeral 10 designates a furnace of a steam generator in which coal is burned. The furnace is top-supported through supports 11. Molten ash and slag are discharged through the furnace bottom opening 12, and falls into the submerged scraper conveyor unit 14. The tank 16 is filled with water 18, and contains a conveyor belt 20 with integral scraper blades in the bottom thereof by means of which the cooled ash and slag is continuously removed from the tank. The conveyor carries the clinkers to the end of the tank, where they can be discharged into trucks or onto a mechanical conveyor (not shown) and transported away. A portion of the water in the tank is constantly removed and replenished (while maintaining a given water level) to maintain the main body of water at a temperature not exceeding 160° F. The tank 16 is mounted on wheels 22, so that it can be removed from beneath the furnace when maintenance work is to be done.

A water seal permits thermal expansion of the top-supported furnace 10 while preventing exposure of the interior thereof to the atmosphere. The water seal is formed by plate 24 which is secured to the bottom of the furnace and extends downwardly into the water in trough 26. The plate 24 extends around the entire periphery of opening 12, so as to completely seal the opening between the furnace 10 and the trough 26. The trough 26 is supported from the bottom by means of four corner posts 28, which are positioned such that they will permit the conveyor unit 14 to be rolled out from beneath the furnace 10 and trough 26 when there is a maintenance shutdown of the unit.

Figure 2:
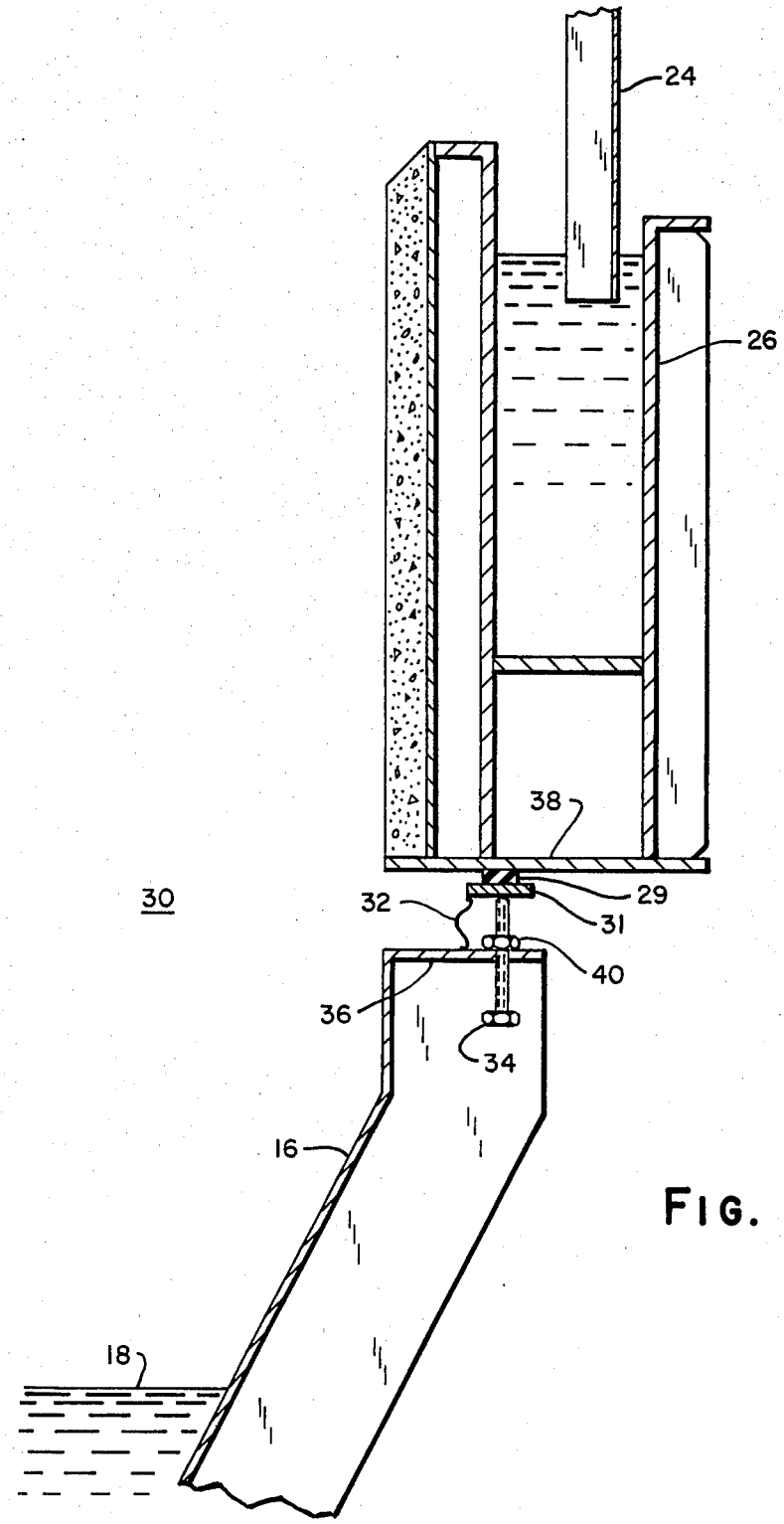
FIG. 2 is an enlarged partial view taken on lines 2—2 of FIG. 1.

As best seen in FIG. 2, a neoprene gasket 29 extends around the entire periphery of upper opening 30 of the tank 16. The plate 31 on which the gasket is secured is attached to the top of the tank 16 by a flexible sheet of metal 32. By means of a plurality of adjustable bolts 34 which are threaded through plate 36, the gasket 29 can be brought into tight sealing engagement with plate 38 when the unit is in operation. Lock nuts 40 can be used to lock the bolts in this position. When it is desired to move the tank 16 from beneath the furnace 10, the lock nuts are loosened and the bolts 34 are threaded downwardly, so as to move the gasket 29 away from plate 38.

The manner in which the unit operates should now be apparent. When it is desired to move the submerged scraper conveyor unit 14 from beneath the furnace 10, lock nuts 40 are loosened, and bolts 34 are threaded downwardly, moving the neoprene gasket 29 away from sealing engagement with plate 38. The tank 16 can then be rolled to either side, away from the furnace. If major work is required, a second or spare tank can be placed beneath the furnace while the other one is being fixed or repaired. The water seal 24, 26 remains in place whether or not the unit is in operation. This apparatus is used for the sole purpose of permitting thermal expansion of the furnace during startup and shutdown.

I claim:

1. In combination, a top-supported furnace in which coal or other ash-bearing fuel is burned, opening means in the furnace bottom, a bottom supported tank opened at its upper end and containing water positioned beneath the furnace opening means, into which the ash from the furnace falls, means for removing the ash from the tank, a water-filled trough supported from the bottom independently of the tank, said trough positioned intermediate the furnace bottom and the tank, plate means secured to the furnace bottom extending down into the water in the trough, which plate means completely surround the open upper end of the tank, seal means between the trough and tank which completely surround the open upper end of the tank, and adjustable means for moving the seal means into and out of tight sealing engagement between the trough and tank, wherein the seal means includes a gasket, and a flexible sheet metal member joining the gasket to the upper end of the tank around its entire periphery.

* * * * *